US008342773B2

(12) United States Patent
Kropacek

(10) Patent No.: US 8,342,773 B2
(45) Date of Patent: Jan. 1, 2013

(54) PAVING APPARATUS

(76) Inventor: Radovan Kropacek, Thunder Bay (CA)

( * ) Notice: Subject to any disclaimer, the term of this patent is extended or adjusted under 35 U.S.C. 154(b) by 0 days.

(21) Appl. No.: 13/290,257

(22) Filed: Nov. 7, 2011

(65) Prior Publication Data

US 2012/0183349 A1 Jul. 19, 2012

Related U.S. Application Data

(60) Provisional application No. 61/432,227, filed on Jan. 13, 2011.

(51) Int. Cl.
*E01C 19/02* (2006.01)
*E01C 19/50* (2006.01)
*E01C 19/52* (2006.01)

(52) U.S. Cl. ..... 404/92; 404/95; 404/101; 425/63

(58) Field of Classification Search ..... 404/92, 404/96, 99, 101, 108; 425/62, 63, 64; 249/1, 249/2, 188
See application file for complete search history.

(56) References Cited

U.S. PATENT DOCUMENTS

| | | | | |
|---|---|---|---|---|
| 992,538 | A * | 5/1911 | Bayley | 404/99 |
| 1,291,544 | A * | 1/1919 | Keenan | 404/93 |
| 1,571,386 | A * | 2/1926 | Straight | 404/99 |
| 1,825,320 | A * | 9/1931 | Kuerts | 404/103 |
| 2,184,906 | A | 12/1939 | Buhrmann | |
| 3,794,458 | A * | 2/1974 | Iwasaki | 425/353 |
| 3,868,200 | A * | 2/1975 | Bratchell | 425/64 |
| 4,068,990 | A | 1/1978 | Kalns | |
| 4,136,991 | A | 1/1979 | Clark et al. | |
| 4,165,617 | A | 8/1979 | Dick, Jr. | |
| 5,662,431 | A | 9/1997 | Colvard | |
| 7,377,719 | B1 | 5/2008 | Elizondo et al. | |
| 2009/0136296 | A1 | 5/2009 | Usdenski | |
| 2010/0044919 | A1 * | 2/2010 | Correia | 264/313 |

FOREIGN PATENT DOCUMENTS

| | | |
|---|---|---|
| EP | 0947632 | 10/1999 |
| GB | 1291269 | 10/1972 |

* cited by examiner

*Primary Examiner* — Gary S Hartmann
(74) *Attorney, Agent, or Firm* — Ryan W. Dupuis; Kyle R. Satlerthwaite; Ade & Company Inc.

(57) ABSTRACT

A paving apparatus is arranged to pave a supporting surface by casting individual paving stones on site on a mobile frame and placing the cast paving stones directly onto the supporting surface in an uncured state adjacent previously placed paving stones as the apparatus is displaced along the supporting surface. Molds are supported by a conveying mechanism of the paving apparatus for movement between a casting position in alignment with a hopper dispensing castable material into the molds and a placing position in which the uncured paving stones are dispensed from the mold directly onto the supporting surface to be paved.

26 Claims, 8 Drawing Sheets

PAVING APPARATUS

This application claims the benefit under 35 U.S.C. 119(e) of U.S. provisional application Ser. No. 61/432,227, filed Jan. 13, 2011.

FIELD OF THE INVENTION

The present invention relates to a paving apparatus arranged to pave a supporting surface by casting individual paving stones and placing the cast paving stones onto the supporting surface as the apparatus is displaced in a forward working direction across the supporting surface, and more particularly, the present invention relates to a method of forming a paved surface by casting paving stones on the paving apparatus and placing the paving stones on the supporting surface in an uncured state adjacent previously placed paving stones while the paving apparatus is displaced along the supporting surface in a working direction.

BACKGROUND

The use of paving stones placed on a mortar bed, a sand or gravel foundation or other suitable supporting surfaces is known for forming various paved surfaces such as roads, driveways, patios and the like. Typically the paved surface is formed by preparing the paving stones off site in a factory, transporting the cured stones to the paving site, and then manually placing the paving stones individually on a prepared foundation bed. The additional steps of manufacturing and transporting of the paving stones and the subsequent manual labor required for installation results in paved surfaces formed with paving stones being very costly in comparison to paved surface formed as a single slab poured on site for example.

In an effort to make the installation of paving stones more efficient, U.S. Pat. No. 2,184,906 by Buhrmann proposes a machine for assisting the placement of paving stones on a prepared mortar bed. The machine only assists in placing previously prepared stones so that the offsite manufacture and transportation of the paving stones is still quite costly compared to many other types of paved surfaces.

U.S. Pat. No. 4,068,990 by Kalns, U.S. Pat. No. 4,165,617 by Dick Jr., U.S. Pat. No. 5,662,431 by Colvard, and U.S. Pat. No. 7,377,719 disclose various devices for paving and related castings. The devices rely on a slip-form in each instance such that the devices are not suitable for preparing individual paving stones as desired in many instances.

U.S. Pat. No. 4,136,991 by Clark et al discloses a roadway marking machine in which markers are formed in respective disposable molds on a mobile frame. The molds are required to be left in placed when the markers are deposited on the roadway. Accordingly the roadway marking machine would not be suitable for use in forming paving stones as the placement of the paving stones directly adjacent one another would prevent the subsequent removal of the disposable molds described.

SUMMARY OF THE INVENTION

According to one aspect of the invention there is provided a paving apparatus for placing a plurality of paving stones on a supporting surface to be paved, the apparatus comprising:

a main frame supported for movement along the supporting surface in a forward working direction;

a hopper supported on the main frame and arranged to receive castable material therein;

a plurality of molds, each comprising at least one mold cavity arranged to receive castable material from the hopper therein such that each mold cavity of the plurality of molds is arranged to form a respective one of the plurality of paving stones; and a conveying mechanism supported on the main frame and including:

a first portion supporting the molds for respective movement from a casting position in alignment with the hopper to a placing position arranged to dispense a cast paving stone therefrom onto the supporting surface; and a second portion supporting the molds for respective movement from the placing position back to the casting position.

The conveying mechanism allows a set of molds to be re-used in a continuous cycle for forming castable material into paving stones and laying the paving stones on a supporting surface to be paved in a single pass of the paving apparatus across the ground.

Preferably the conveying mechanism is arranged to release each mold from the first portion of the conveying mechanism at a location spaced forwardly from the second portion prior to engaging the mold with the second portion of the conveying mechanism.

Preferably the conveying mechanism includes a casting section arranged to support each mold in the casting position such that the conveying mechanism is arranged to release each mold from the second portion of the conveying mechanism at the casting section prior to engaging the mold with the first portion of the conveying mechanism.

Preferably each mold comprises a plurality of mold cavities.

In some embodiments the mold cavities of each mold are arranged in a respective lateral row of cavities. Thee molds may include first and second mold types in which the mold cavities of the first mold type are staggered so as to be laterally offset from the mold cavities of the second mold type.

Preferably the main frame includes a placing section extending in a longitudinal direction rearwardly from the first portion of the conveying mechanism at a forward end of the main frame to the second portion of the conveying mechanism at a rearward end of the main frame in which the placing section is arranged to receive a longitudinally extending row of the molds in the respective placing position.

Preferably the main frame includes a roller base arranged to support the main frame for rolling movement in the forward working direction on the longitudinally extending row of molds in the placing section between the first and second portions of the conveying mechanism.

Preferably the roller base is centrally located between the front and rear ends of the main frame so as to be arranged to substantially fully support a weight of the apparatus thereon.

Preferably a biasing mechanism is arranged to bias each mold during placement on the supporting surface rearwardly against one of the molds previously placed on the supporting surface.

Preferably a metering mechanism is arranged to deliver metered portions of castable material from the hopper to the molds in the casting position.

When the molds include first and second mold types which are different in configuration from one another, the metering mechanism is preferably arranged to deliver first and second metered portions to the first and second mold types respectively.

Preferably a packing tool is supported on the main frame above the molds in the casting position in which the packing tool includes a packing head arranged for engaging an open side of the molds and a driver arranged to substantially vertically reciprocate the packing head so as to be arranged for packing the castable material in the molds.

When the molds include first and second mold types which are different in configuration from one another, the packing head of the packing tool preferably comprises modular sections such that the driver is arranged to reciprocate different ones of the modular sections of the packing head in first and second packing modes corresponding to the first and second mold types respectively.

Preferably a primary packing tool is supported on the main frame above the molds in the casting position so as to be arranged to pack the castable material in the molds in the casting position, and a secondary packing tool is supported on the main frame so as to be arranged to pack the castable material in the molds in a secondary packing position forwardly in relation to packing by the primary packing tool in the casting position.

When the molds include first and second mold types which are different in configuration from one another, preferably a chute is arranged to guide castable material from the hopper into each mold in the casting position. In this instance the chute may include gate members mounted for sliding movement relative to the chute so as to be arranged to vary the chute between first and second configurations corresponding to the first and second mold types respectively.

Preferably a sweep mechanism is supported on the main frame so as to be arranged to sweep respective sides of each mold when the mold is supported by the first portion of the conveying mechanism.

Preferably a return mechanism is arranged to convey material swept by the sweep mechanism to the hopper.

Preferably a hammering mechanism on the apparatus includes a reciprocating hammer arranged to engage each mold in the placing position so as to be arranged to release the respective cast paving stone from the mold.

Preferably the conveying mechanism is arranged to dispense cast paving stones on the supporting surface in a longitudinally extending row as the main frame is displaced in the forward working direction. In this instance, preferably an alignment tool on the main frame is arranged to guide the main frame along a previously placed longitudinally extending row of cast paving stones as the main frame is displaced in the forward working direction.

When the main frame includes a roller base arranged to support the main frame for rolling movement on molds placed on the supporting surface in the placing position, preferably the front and rear wheels at respective forward and rearward ends of the main frame which are adjustable in height relative to the roller base so as to be arranged to support the main frame thereon with the roller base spaced above the ground in a transport position.

When the main frame includes a roller base arranged to support the main frame for rolling movement on molds placed on the supporting surface in the placing position, preferably the front wheel on the main frame is spaced forwardly of the roller base and is lower in elevation than the roller base so as to be arranged for rolling movement on the supporting surface when the roller base rolls on the molds in the placing position.

Preferably the front wheel comprises a roller which spans a majority of a width of the apparatus in a lateral direction.

Preferably the front wheel is adjustable in position relative to the main frame in a lateral direction oriented transversely to the forward working direction.

Preferably a sweep mechanism supported on the main frame is arranged to sweep an interior of each mold when the mold is supported by the second portion of the conveying mechanism.

Preferably a release sprayer mounted on the main frame is arranged to spray a mold releasing agent into each mold at a location prior to the casting position.

Preferably a finish sprayer mounted on a rear end of the main frame is arranged to spray a finish coating on an upper surface of the cast paving stones on the supporting surface subsequent to the respective mold being engaged by the second portion of the conveying mechanism.

According to a second aspect of the present invention there is provided a method of paving a supporting surface with paving stones, the method comprising:

providing a paving apparatus comprising a main frame, a hopper supported on the main frame for receiving castable material therein, at least one mold on the main frame arranged to receive castable material from the hopper therein so as to form the paving stones, and a conveying mechanism on the main frame;

displacing the main frame along the supporting surface in a forward working direction;

dispensing a castable material from the hopper into said at least one mold;

casting the plurality of paving stones from the castable material in said at least one mold; and conveying the cast paving stones on the conveying mechanism from a casting position on the main frame to a placing position on the supporting surface; and placing each cast paving stone in the placing position on the supporting surface while the cast paving stone remains in an uncured state such that the cast paving stone is adjacent to a previously placed cast paving stone on the supporting surface.

The method may further include cutting and removing a portion of some of the cast paving stones while in the uncured state subsequent to placement of the cast paving stones on the supporting surface. Cuffing of the paving stones in an uncured state allows a contour of an area to paved with stones to be easily defined regardless of the shape thereof because a simple knife is typically sufficient for cutting in the uncured state.

The method may further include providing a sprayer on the paving apparatus and spraying a coating onto the paving stones in an uncured state subsequent to placement of the cast paving stones on the supporting surface. Sparing of a coating on the paving stones prior to curing of the stones allows the coating to more readily penetrate and bond to the paving stones to improve the quality of the coating. The sprayer on the paving apparatus also improves efficiency by casting, placing and coating paving stones in a single pass of the paving apparatus.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
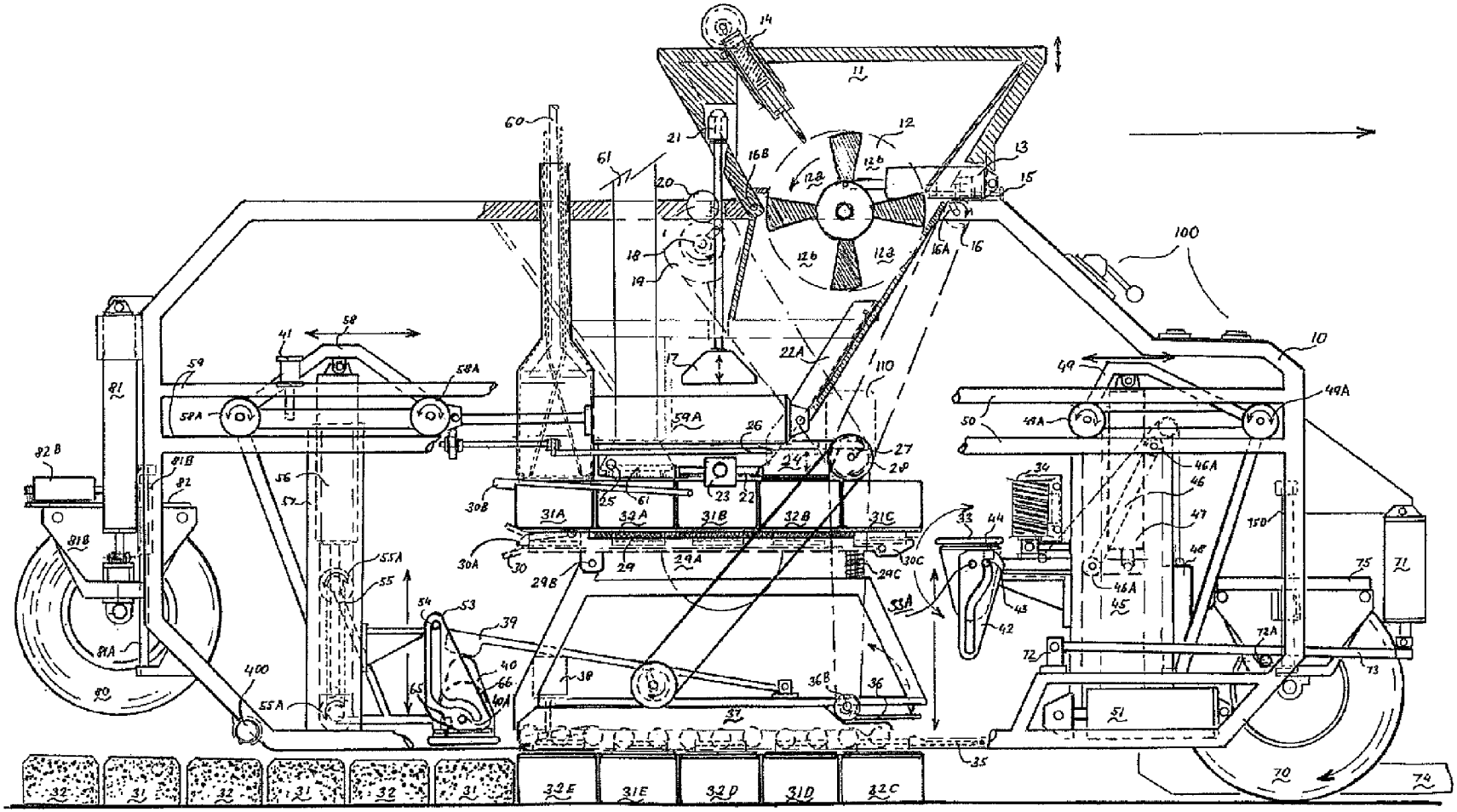
FIG. 1 is a partly sectional side elevational view of the paving apparatus.

Referring to the accompanying figures, there is illustrated a paving machine or paving apparatus generally indicated by reference numeral 10. The apparatus 10 is particularly suited for forming a paved surface by forming and then placing individual paving stones on a prepared foundation bed or other suitable supporting surface 120 as the apparatus is displaced across the supporting surface.

The apparatus 10 generally comprises a main frame supported for movement along the supporting surface in a forward working direction. In particular the main frame includes a front wheel 70 at a front end of the main frame and a rear wheel 80 at the rear end of the main frame in which each of the wheels comprises a wide single roller or series of wheels which together define the roller which spans a majority or a substantial portion of the width of the apparatus in the lateral direction. The wheels are moveable between a transport position in which the main frame is raised above the supporting surface so as to be supported entirely on the front and rear wheels, and a working position in which a substantial portion of the apparatus is supported for rolling movement on molds forming paving stones that already placed on the supporting surface while the front wheel remains lower in elevation than the remainder of the apparatus for rolling movement on the supporting surface ahead of molds already placed on the supporting surface.

The main frame further comprises a power unit 110 such as a motor for example to provide power to various components of the apparatus. The apparatus typically also comprises a compressed air supply 200, an electrical power supply 210, a high pressure water supply 220 and vacuum power 230 for operating the various components of the apparatus. A control panel 100 provides suitable control of the various components depending upon the particular paving application.

The main frame supports a hopper 11 at the top end of the apparatus in which the hopper includes an open top end arranged to receive castable material loaded therein. The hopper delivers the castable material to a metering mechanism 12 which meters prescribed amounts of the castable material for delivery to a plurality of molds also supported on the frame as described in further detail below.

The molds in particular include a first mold type 31 having three mold cavities therein and a second mold type 32 having two cavities therein in which the cavities of the second type are identical in sizing configuration to those of the first type but are offset in the lateral direction so as to be staggered in relation to the mold cavities of the first mold type when positioned adjacent one another.

All of the mold cavities within each mold are aligned in a laterally extending row oriented perpendicularly to the forward working direction of the apparatus. The mold cavities of each mold are integrally joined with one another such that each mold is an integral member arranged to be supported on the main frame for movement between a casting position in alignment with the hopper to receive the castable material therefrom and a placing position therebelow in which the mold is arranged to dispense a cast paving stone therefrom onto the supporting surface.

The molds are mounted on a conveying mechanism in a continuous loop to be alternately displaced between the casting and placing positions for filling the molds and dispensing cast paving stones from the molds in a continuous cycle as the apparatus is displaced in the forward working direction. The series of molds in the continuous loop of molds are positioned in an alternating sequence between first and second mold types such that each first mold type is positioned between two second mold types and each second mold type is similarly positioned between two first mold types.

The conveying mechanism includes a casting section in which a longitudinal row of molds are abutted in series with one another in the longitudinal direction extending between the front and rear ends of the frame. A central one of the molds in the casting section defines the casting position in alignment with the hopper.

The conveying mechanism further includes a first portion 33 comprising a front fork unit in the form of a linkage which transfers each mold one at a time from the casting position to the placing position and more particularly from a casting section to a placing section therebelow. In doing so, the mold carried by the first portion 33 is lowered and flipped 180 degrees to be inverted in the placing section relative to the casting section. In the placing section, a plurality of the molds are similarly abutted with one another to define a longitudinally extending row of molds extending in the longitudinal direction.

The first portion of the conveying mechanism is located at the front end of the frame spaced forwardly in relation to a second portion 40. The second portion 40 defines a rear fork unit which comprises a linkage which displaces each mold one at a time from the rear of the placing section to the rear of the casting section thereabove. During the movement of the molds by the second portion of the conveying mechanism, the molds are raised and flipped 180 degrees.

The first portion of the conveying mechanism is arranged to release each mold therefrom at the front of the placing section well ahead of the engagement of the second portion of the conveying mechanism with the mold at the rear of the placing section. Similarly the second portion of the conveying mechanism releases each mold at the rear of the casting section at a location spaced rearwardly from engagement of the first portion of the conveying mechanism with the mold units at the front end of the casting section.

Each mold includes a pair of lateral support flanges projecting laterally outward from opposing ends of the row of cavities to assist in handling of the molds through the various sections and by the front and rear forks defining the first and second portions of the conveying mechanism.

At the casting section, the frame includes two tracks 30 comprising generally U-shaped channels with open sides facing inwardly towards one another for receiving respective ones of the support flanges of the molds for sliding movement therein in the longitudinal direction as the molds are conveyed through the casting section. The molds are displaced forwardly through the casting section in a horizontal sliding movement in the tracks at periodic intervals to sequentially align each mold with the hopper in the casting position.

To provide additional support to the molds passing through the casting section, there is provided a press base table 29 directly below the molds upon which the molds are supported. The press base table includes a vibrator **29*a* mounted to the bottom side thereof to vibrate the table to assist in settling of the castable material placed in the molds. Suitable pivots 29***b* support one end of the press table relative to the main frame while springs 29*c* support the opposing end of the table relative to the frame so that the table is permitted some small degree of relative movement when the vibrator 29*a* vibrates the base table.

The side tracks which guide the mold units over the press base table include rear locks 30*a* which automatically open at the rear end of the casting section to allow another mold to be inserted into the tracks 30 by the second portion of the conveying mechanism. Each time a new mold unit is inserted past the rear locks, the rear locks 30*a* automatically re-engage to prevent the mold units from subsequently being pushed rearwardly off the back of the press table tracks 30.

Additional support is provided to the molds on the press base table by a rear holder bar 30*b* which is similarly supported to prevent rearward movement of a mold on the base table beyond the rear end of the tracks. The holder bar is automatically deflected upwardly out of the way as a new mold is inserted forwardly through the rear end of the tracks. The holder bar provides support to the top edge of the rearwardmost mold unit to keep the top end of the molds tight together with one another on the press base table.

Front locks 30*c* are provided at the forward end of the casting section which are similarly arranged to keep the mold units tight together on the tracks 30 until an additional mold unit is loaded through the rear end of the tracks onto the casting section. Holding the mold unit tight together with one another through the casting section prevents excess castable material from falling between the molds.

To assist in guiding castable material from the hopper into the mold in the casting position centrally on the casting section, a chute member 24 is supported directly above the molds in the casting section. The chute member is arranged to span over and cover the molds located both immediately in front of and immediately rearward of the central mold in the casting position while including a slot therein aligned with the open top end of the mold in the casting position. The front and rear side walls of the slot in the chute member 24 are tapered downwardly and inwardly for gathering the castable material into the open top end of the mold. Directional gates 22*a* are provided above the chute member to also guide material from the hopper thereabove downwardly and inwardly to the slot in the chute member 24.

The chute member is operable between first and second configurations of the slot to accommodate the first and second mold types respectively. In particular the chute member is provided with a pair of gates 22 at laterally opposed ends of the slot for covering portions of the slot which do not overlap the smallest of the first and second mold types. By opening the gates, the slot corresponds in size to the open top end of the three cavities of the first mold type. When closing the gates in the second configuration, the laterally opposed ends of the slot are shortened by the gates respectively such that the remaining open portion of the slot in the chute member 24 corresponds to the open top end of the two mold cavities of the second mold type. Suitable actuators 23 are associated with the two gates for guiding the opening and closing of the gates 22.

The hopper 11 includes two laterally opposed side walls and longitudinally opposed front and rear walls spanning between the side walls which are tapered downwardly and inwardly towards one another to a slot at the bottom end through which the castable material is dispensed by the metering mechanism. The metering mechanism generally comprises a cylindrical member spanning the slot in the bottom end of the hopper for rotation about a laterally extending axis. Alternating cavities 12*a* and 12*b* are located at circumferentially spaced positions about the cylinder of the metering mechanism for gathering castable material from the hopper when facing upwardly and for carrying the castable material therein as the cylinder is rotated to a bottom side where the material is dispensed therefrom in a metered amount. The alternating first and second cavities 12*a* and 12*b* correspond approximately in volume to the volume of castable material required to fill the collective volume of the cavities of the first and second mold types respectively. Each of the first and second cavities thus delivers a respective first or second metered amount of material from the hopper to a position below the hopper where it is dispensed into the first or second mold types respectively.

An adjustable scraper 14 is mounted adjacent the rotating cylinder of the metering mechanism 11 to remove excess castable material from the cylinder as the cylinder rotates for controlling the intake flow of castable material. An adjustable scraper 15 is also mounted in proximity to the metering mechanism for cleaning the rotating cylinder 12 as the metered amount of material is dispensed therefrom at the bottom side.

A piston cylinder 13 is coupled to the rotating cylinder of the metering mechanism for driving the rotation thereof at a suitable rate corresponding to the rate of placement of sequential molds below the slot in the chute member 24.

To assist in packing of the castable material in the molds, a primary hammer press or packing tool includes a packing head formed in modular sections. The main section 17 of the primary packing head corresponds to an area which is in common to both the first and second molds types. The mold head specifically spans the full open top side of the common area of the first and second mold types. The packing head also includes two auxiliary sections 17*a* and 17*b* respectively which correspond in area to the open top end of the area associated with only the larger first mold type. Accordingly the main section 17 corresponds to the area in the slot of the chute member 24 which remains uncovered by the gates 22 while each of the auxiliary sections 17*a* and 17*b* correspond to an area covered by the gates 22 respectively.

The various sections of the packing head of the primary packing tool are supported on respective vertical rods slidably mounted on the frame of the apparatus by respective bushings. A suitable driver is provided for reciprocating the packing heads in a vertical direction for impacting the top end of the castable material in the molds during a primary packing operation in the casting position of the mold. The driver in particular includes a cam shaft 18 for lifting of the hammers and shock absorbers 21 at the top ends of the rods to enable the lifting and lowering of the packing heads onto the castable material. A sprocket 19 is coupled to the cam shaft 18 so as to be driven to rotate by the output of the power unit 110 through connection of suitable pulleys for example.

Power locks 20 are provided in association with the two auxiliary sections 17*a* and 17*b* of the primary packing head to prevent the reciprocating movement of those sections when each second mold type is aligned in the casting position therebelow. Alternately when a first mold type is aligned in the casting position, the power locks 20 are released so that all of the sections of the primary packing head are reciprocated together.

Secondary packing is provided by the chute member 24 which functions as a secondary packing tool at a position forward of the mold in the casting position. This is accomplished by the bottom side of the chute 24 ahead of the slot therein which defines a respective secondary packing head fully spanning the top end of either of the first or second mold types. The chute 24 is supported by a hinge 25 at the rear end thereof while a suitable cam shaft 27 is coupled adjacent the forward end for reciprocating the forward end in an up and down movement when the cam shaft is rotated. The cam shaft 27 includes a drive pulley 28 associated therewith in which the drive pulley is similarly coupled to the output of the power unit 110.

A wedge member 26 is supported along each of the laterally opposed sides of the chute member 24 for sliding engagement between a released position and a wedged position. In the wedged position, the wedges are inserted between a fixed portion of the frame and an adjustable member on the chute member 24 to provide some slight height adjustment by varying the penetration of the wedge member into the wedged position. This functions to control the level of material in the mold prior to the mold entering the secondary packing area by fine tuning the height of the bottom side of the chute member 24 which functions as a scraper across the open top ends of the molds as the molds are advanced forwardly through the casting section.

Turning now to the conveying mechanism, the first portion of the conveying mechanism corresponding to the front fork unit includes a carriage assembly supported on a first frame 46 for vertical sliding movement as controlled by a first piston cylinder 47 oriented in a vertical sliding direction. The carriage and first piston cylinder 47 are in turn supported on a second frame 49 supported for rolling movement on the main frame by rollers 49*a* such that the first portion of the conveying mechanism is horizontally slidable in the longitudinal direction relative to the main frame. Front horizontal tracks 50 are provided on the main frame to receive the rollers 49*a* rotatably therein for guiding the horizontal movement of the unit 33 relative to the main frame. Piston cylinders 51 associated with the first portion of the conveying mechanism serve to control the horizontal sliding movement of the unit 33 and frame 49 in the horizontal direction along the track 50. The carriage is also supported on vertical tracks 45 on the front roller frame 49 such that the vertical tracks 45 guide the vertical sliding movement of the unit 33 relative to the main frame.

The forks 33 are arranged for mating connection to the respective mold being carried thereon such that locks 44 permit the mold to be fixed to the unit 33 as the unit displaces the mold from the casting section to the placing section. The unit 33 is supported by a suitable linkage with a pivot point 33*a* about which the unit 33 is pivoted through 180 degrees between the casting position and the placing position. The units 33 are pivoted relative to the first frame 46 of the unit which is in turn supported for vertical sliding movement in the front tracks 45 by suitable rollers 46*a*. A counter weight 48 is coupled to the vertical sliding frame for smoothing and controlling the downward movement thereof.

Offset anchor points 43 are provided on the frame 46 offset from the main pivot 33*a* corresponding to the center point anchored to the frame of unit 49 for cooperating with slots in front fork unit guides at laterally opposed sides of unit 33. The slots and the guides slidably receive the anchor points 33 therein such that downward movement of the unit 33 forces the guides to move around the anchor points 43 to actuate the 180 degree rotation of the unit followed by the linear downward movement through the remainder of the conveying of the mold unit from the casting section to the placing section.

A suitable spring 52 provides appropriate biasing force to apply an instant primary force with the mold unit is in an engaging mode. In particular, the first portion of the conveying mechanism together with the biasing mechanism serves to urge each mold unit rearwardly against a previously placed mold unit on the supporting surface as the main frame is displaced in the forward working direction. After each new mold is abutted against a previously placed mold in the longitudinal direction, the actuators of the first portion of the conveying mechanism return the mechanism to a starting position to accept a new mold to be lowered and abutted against a previously placed mold.

A primary sweeper 34 is provided on the frame of the first portion of the conveying mechanism in the form of a rotating brush supported for engaging the mold unit carried by the first portion of the conveying mechanism between the casting and placing positions. In particular the primary sweeper 34 serves to position the brush for engaging and cleaning the sides of the mold unit together with high pressure water and vacuum power to assure that the sides of the mold are clean enough for tight abutment against a previously placed mold.

A secondary sweeper 36 is also provided to scrape off foreign material from the molds. The secondary sweeper includes a connecting arm 36*a* which controls the position of the secondary sweeper to first engage the upcoming unit 33 while pushing the arm to rotate 90 degrees for dumping left over material through it's opening to be subsequently picked up by a return mechanism in the form of a screw conveyor 36*b*. The screw conveyor 36*b* carries the swept material back to the hopper 11 to be deposited therein.

Locks 35 are provided to keep the mold units in their proper location once placed into the placing section in combination with stopping the paving machine from moving subsequent to each placement of a mold on the supporting surface.

The main frame includes a main roller base 37 comprising two laterally spaced rows of rollers extending in the longitudinal direction and being supported for rolling movement in the longitudinal direction on the molds in the placing section which have already been placed in position on the supporting surface. By adjusting the height of the front and rear wheels, substantially all of the weight of the main frame and the apparatus as a whole can be supported on the roller base which is centrally located between the front and rear ends of the apparatus in the longitudinal direction. The roller base spans the length of the placing section in the longitudinal direction such that the roller base rolls onto each mold immediately after its placement in the placing section after release from the first portion of the conveying mechanism. Similarly the roller base rolls off of each mold as it exits the placing section immediately prior to engagement with the second portion of the conveying mechanism for lifting the mold back to the casting section.

A pair of laterally opposed base flanges are provided along the bottom side of the main frame of the apparatus to be received below the support flanges at opposing ends of the mold in the placing position. In this manner, when the main frame is lifted by lowering the front and rear wheels, the molds remain engaged against the rollers due to the side flanges overlapping in the lateral direction beneath the support flanges of the molds at opposing ends thereof.

In addition to the locks 35 at the forward end of the placing section which maintain the mold units in the placing section in tight engagement with one another, power locks 38 are also provided at the rear of the placing section to lock the rearwardmost mold of the placing section relative to the main frame as the forwardmost mold in the placing section is urged rearwardly in tight abutment against the previously placed molds.

To assist in releasing the cast paving stones from the molds as the molds are lifted out of the placing section, a series of hammers 39 are supported on respective arms pivotally mounted at one end on the main frame and arranged for reciprocating hammering or impacting movement with the frame supporting the rear fork unit 40 thereon when the fork unit is engaged with a mold to be lifting from the placing position to the casting position. A hammer motion vibrator 66 may also be mounted on the unit 40 to which the mold is secured by rear power locks 65 upon engagement of the second portion of the conveying mechanism with the mold at the rear of the placing section.

The rear unit 40 of the second portion of the conveying mechanism is arranged to clamp the mold being conveyed thereon using suitable locks which lock the mold to the head of the unit 40. The unit 40 is pivoted at a main pivot 40*a* on a rear vertical roller frame 55 supported for vertical sliding movement by rollers 58 which roll along respective rear vertical tracks 57 to guide the up and downward movement of the unit 40.

The tracks 57 are in turn supported on a rear horizontal roller frame 58 supported by respective rollers 58 in tracks 59 on the main frame to guide the unit 58 together with the unit 40 thereon for horizontal inward and outward sliding movement relative to the main frame. A suitable actuator 59*a* is coupled between the roller frame 58 and the main frame to control the horizontal position thereof. Similar to the front fork unit, the rear fork unit includes a pair of laterally opposed guides 53 moveable with the unit 40 and having slots therein which cooperate with offset anchored pivot points 54 offset from the main pivot 40*a* and which are fixed relative to the vertical movement of the roller frame 55 so that as the roller frame displaces the carriage of the unit 40 upward, the guides are pivoted by the interaction of the slots in the guides and the anchor points 54 to lift and subsequently invert the molds through a range of 180 degrees between the placing section and the casting section.

An additional sweeping mechanism 60 is provided towards the rear of the main frame in alignment with the rearwardmost mold on the casting section defining a sweeping position for cleaning out the interior of the mold prior to re-filling with castable material. In particular the sweeping mechanism 60 includes use of high pressure water directed at the interior of the mold together with brushes and vacuum power to remove debris.

At a treating position within the casting section between the rearwardmost sweeping position of the molds and the casting position of the molds, the mold can be treated with a release agent by a release sprayer unit 61 which sprays a mold releasing agent into each mold prior to the casting position. The release agent may not be required in some instances as the hammering motion imparted by the power hammers 39 may be sufficient.

In use, the frame is primarily supported on the roller base on the mold units in the placing section. To drive the forward movement in the working position, the pistons 51 which push each mold rearward against a previously placed mold act to advance the frame of the apparatus forwardly relative to the previously placed molds. The front wheel 70 is lowered in elevation below the roller base for engaging the supporting surface upon which the molds were placed during the working position.

A driven sprocket 70*a* is coupled to the front wheel for connection to a suitable drive unit to drive the forward motion in transport position. This sprocket is disconnected in the working position so that only the pistons 51 drive forward movement in the working position.

In the illustrated embodiment a power unit 75*a* is supported on a front wheel base together with the front wheel 70 such that the entire base 75 is moveable relative to the main frame to adjust the height thereof. A push down frame assembly 73 is anchored to the main frame at pivot 72 while being pivoted to the base 75*e* of the power unit base at an intermediate location. An opposing end opposite from the pivot 72 is coupled to the main frame through the lift cylinder 71 such that adjusting the length of the lift cylinder 71 acts through the push down frame assembly to adjust the height of the power unit base relative to the main frame. The power unit base is supported by linear bearings 75*e* for linear sliding movement on vertical guides 75*d* on the main frame.

The main frame is arranged to be guided along a previously placed longitudinally extending row of cast paving stones as the frame is displaced in the forward working direction by an alignment tool 74 offset to one side of the front wheel 70 in the form of a longitudinally extending plate slidable against the ends of the previously placed stones. When providing a staggered arrangement of paving stones, the alignment tool 74 is positioned in alignment with one of the laterally opposed ends of the second mold type such that a portion of the first mold type overlaps the alignment tool 74 in the lateral direction for nesting between previously laid stones along which the alignment tool is slidably engaged. The front wheel 70 can be aligned in the lateral direction relative to the main frame for positioning the alignment tool 74 on the main frame in tight engagement with the previously laid stones. This horizontal alignment is provided by supporting the power unit base 75 on the vertical guides 75 for relative horizontal sliding movement by horizontal guides 75*c*. A suitable actuator 75*b* permits the lateral position of the base unit 75 to be accurately controlled relative to the main frame.

To drive the forward rolling movement of the front wheel, the sprocket 70*a* at the end of the wheel is coupled through a suitable drive chain to a drive sprocket 70*g* which is selectively coupled to the output of the power unit 75*a* by a suitable clutch 75*f*. An aligner assembly 75*h* allows lateral alignment of the drive and wheel relative to the remaining components.

The rear wheel 80 is similarly supported for adjustment relative to the main frame. In particular the rear wheel is rotatably mounted on a rear wheel base 82 which permits the rear wheel to be steered about a vertical steering axis at the pivot 82*a* centrally located above the rear roller. A steering actuator 82*b* controls the position of the rear wheel about the vertical axis of the pivot 82*a* for controlling the steering of the apparatus when in the transport position. The pivot assembly 82*a* and the rear wheel 80 upon which it is supported are both supported on horizontal guides 82*c* allowing some lateral movement of the rear wheel relative to the main frame. A suitable actuator 82*d* offset to one side controls the horizontal position of the rear wheel base along the horizontal guide 82*c* in the lateral direction. The lateral adjustment, the vertical steering adjustment and the wheel itself are all in turn carried on respective vertical guides 81*a* by linear bearings 81*b* to permit vertical sliding of the rear wheel relative to the main frame. The piston cylinders 81 at the rear of the frame are coupled between the main frame and the linear bearings 81*b* to control the vertical position of the wheel 80 relative to the main frame. In particular the rear wheel can be controlled between a working position of the apparatus spaced above the stones being placed so as to be out of use, and a transport position in which the rear wheel is lowered below the roller base to support the apparatus entirely on the front and rear wheels for transport.

Figure 6:
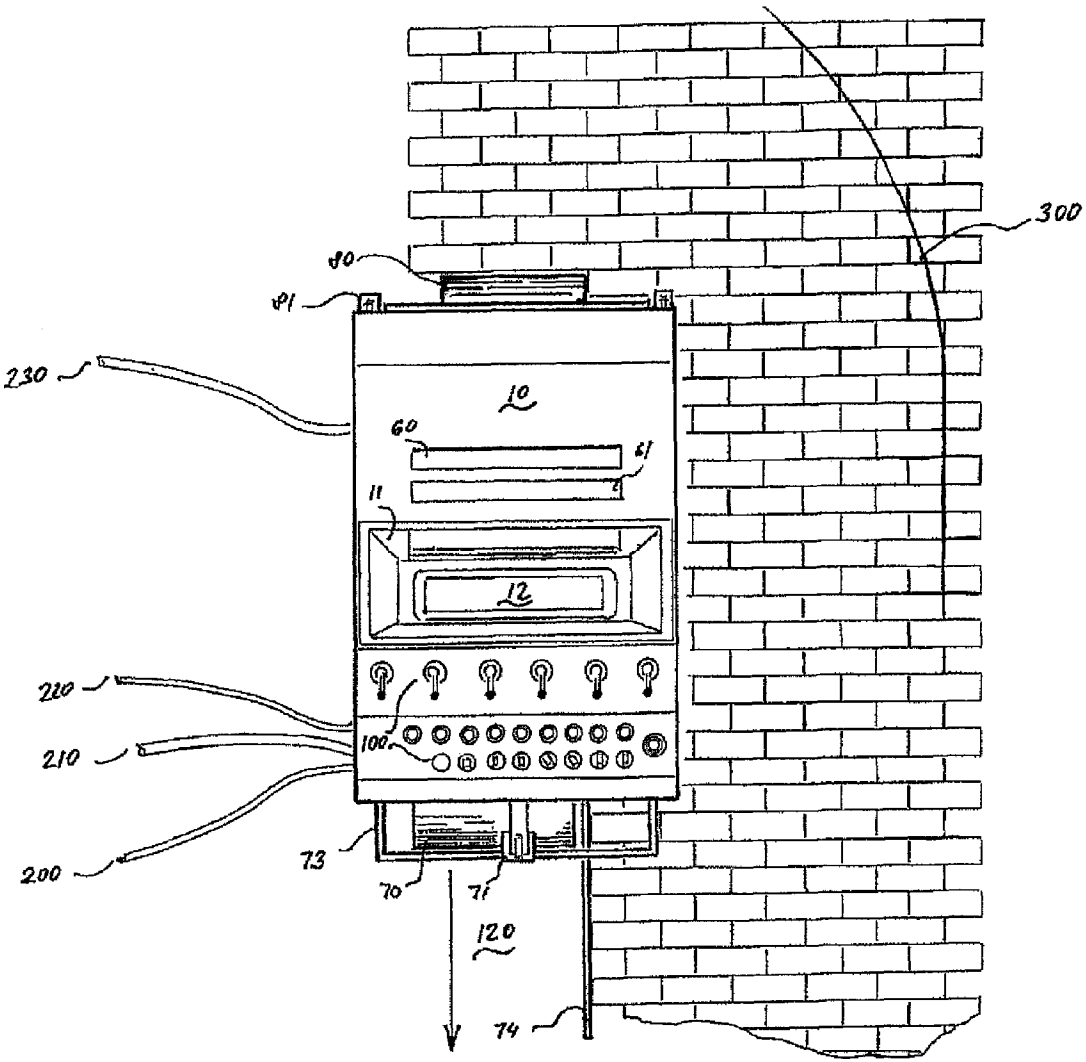
FIG. 6 is a top plan view of the paving apparatus in use.
Figure 7:
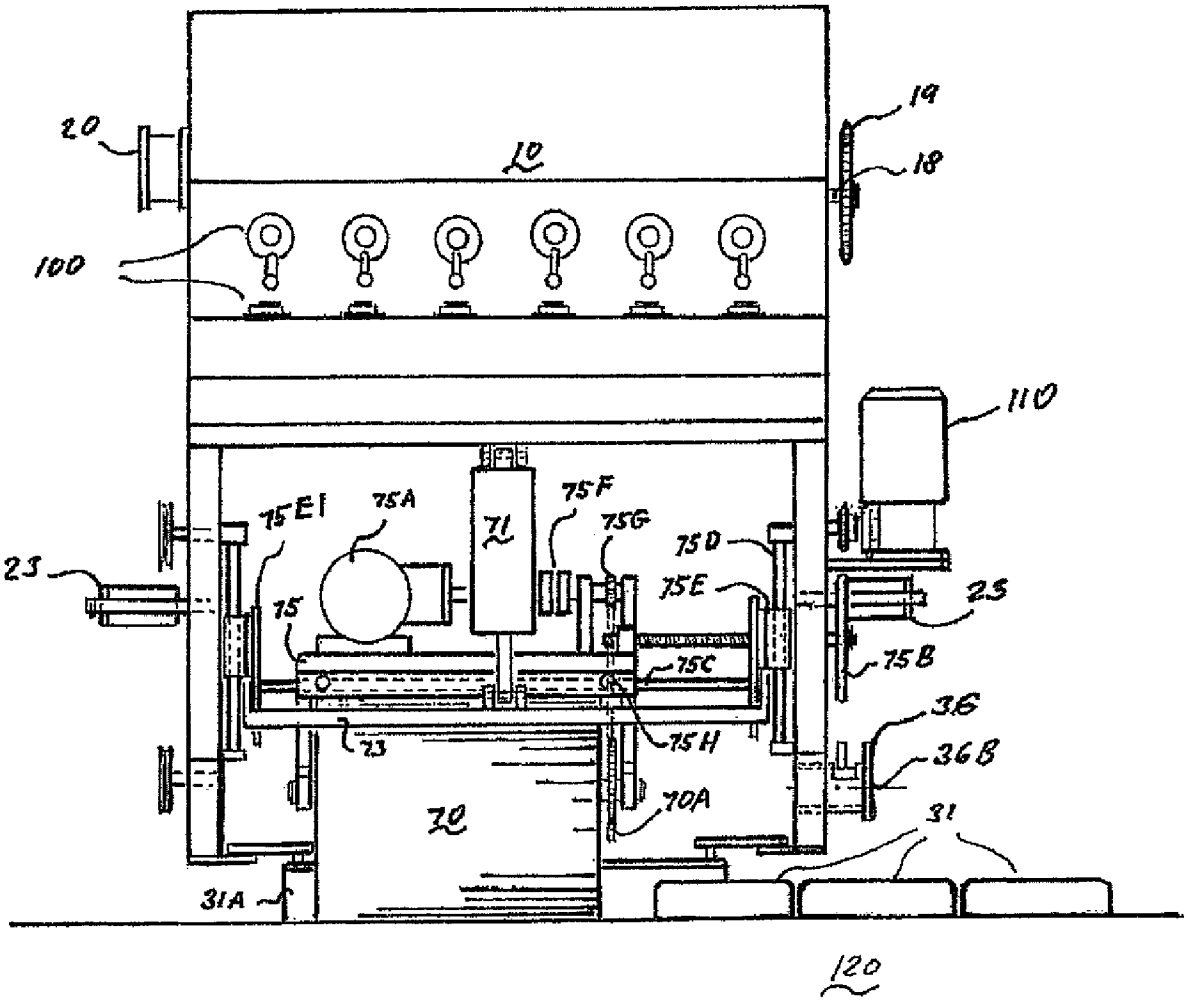
FIG. 7 is a front elevational view of the paving apparatus.
Figure 8:
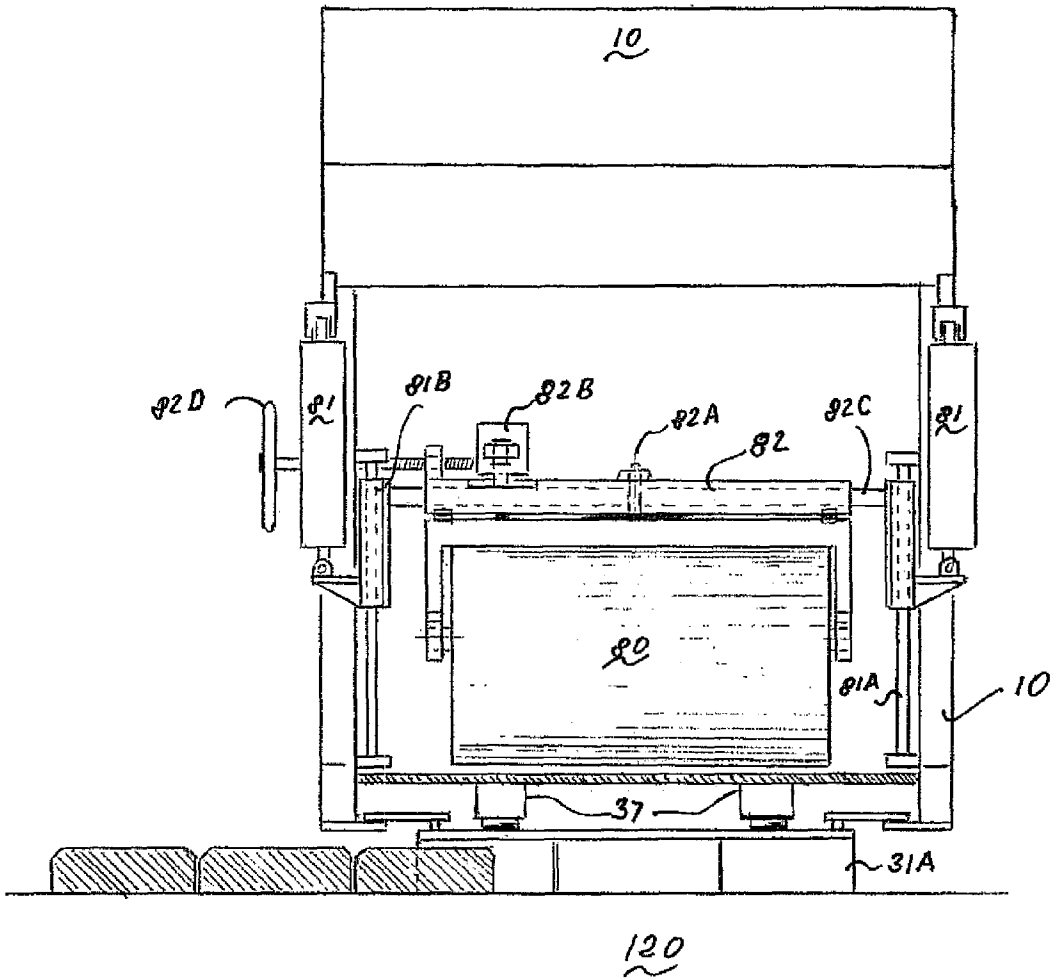
FIG. 8 is a rear elevational view of the paving apparatus.

A coating sprayer 400 is mounted on the main frame adjacent the rear end thereof for spraying a coating material downwardly onto paving stones which have already been placed on the supporting surface and which have had the molds removed therefrom. In particular the sprayer 400 sprays a finished coating, for example paint and the like onto the upper exposed surface of the paving stone while the stone remains in an uncured state. Because of the ability of the machine to accurately place paving stones while they remain in an uncured state as they are released from the apparatus, various contours 300 can be readily formed at the perimeter of an area to be paved by simply cutting the uncured pavement along any desired cutting path as best shown in FIG. 6.

As described herein a paving apparatus is arranged to receive castable material in the hopper thereof so that the material can be cast into molds and dispensed from the molds onto a suitable supporting surface on a single frame displaced across the ground in a forward working direction to pave the supporting surface with paving stones. The molds are rotated by the conveying mechanism between the casting and placing positions such that the paving stones cast in the molds are conveyed with the molds from the casting position to the placing position on the supporting surface while the molds remain reusable by subsequent lifting back into the casting position as the paving apparatus continues to move forwardly across the ground. Typically each cast paving stone is placed on the supporting surface while the cast paving stone remains in an uncured state such that the paving stone is adjacent to a previously cast paving stone on the supporting surface which can be coated together therewith while all the stones remain in the uncured state.

As described above, the paving machine 10 is equipped with an inlet 11 to calibrate castable material. It is done by rotating a caliper 12 having two different sizes of cavities—one for the mold unit consists of two mold cavities 12*a*, second for the mold unit of three cavities 12*b*. The piston cylinder 13 rotates caliper 12 to deposit material in to mold unit positioned on a press base table 29 having the slight radius to keep top edge of the mold units together. The adjustable downward scraper 14 precisely controls intake flow of the amount of castable material to be dropped down in to mold unit cavities.

The inlet unit 11, rotating caliper 12, piston cylinder 13, adjustable scraper 14, 15 are positioned on the main frame. This assembly is attached to the machine 10 by pivots 16*b*. The power unit 110 drives pulley combined with the camshaft 16*a* to create hammer motion of the intake unit 11.

Downward flow of castable material is directed by the gates 22A connected to gates 22. The purpose of it is to direct material to: mold units consisting of two cavities 32A,B,C,D,E or three cavities 31A,B,C,D,E.

The power lock 20 stops the side hammers 17*a,b* in upper position combined with the gates 22 in closed position for mold units consisting of two cavities. While depositing material into molds positioned on the press base table 29, the primary hammer motion press 17 is compacting material. In appropriate time the mold unit carrying compacted material is pushed forward by the rear pick up units 40 and 58 carrying empty molds. At the same time the wedge shaped spacer 26 is engaged to create proper level of material before it enters the secondary press 24.

The secondary press unit 24 includes: gates 22, piston cylinders 23. This assembly is attached to the paving machine frame by pivots 25. The power unit 110 drives pulley 28 combined with camshaft 27 to create a hammer action motion of the secondary press unit 24. At this moment the material is fully compact and the mold unit is ready to be picked up by fork unit 33 and 49 positioned in the start up location. The unit 33 and 49 moves in the horizontally inward direction by extracting the piston rod of the cylinders 51. Unit 33 engages in to a mold unit, and power locks 44 secure the mold unit to unit 33.

At this moment the side of the mold unit is in contact with primary sweeper 34 to sweep off the spills which are returned back into inlet 11. The units 33 and 49 carrying the mold unit moves outwards by retracting the piston rod of the cylinders 51. The unit 33 moves downwards, rotates 180 degrees around the anchored pivots 43 by extracting the piston rod of the cylinder 47. The counter weight is used for smooth downwards movement. After its 180 degree rotation is completed, the unit 33 keeps going straight down. At this moment sides of the mold unit are in contact with secondary sweeper 36 to make sure there is no foreign material between the mold unit engaged and the mold unit already positioned on a prepared bed 120.

The spills of material are returned back to inlet of unit 11 by a secondary sweeper 36 combined with the screw conveyor 36B as soon as the mold units starts overlapping. By releasing air pressure from the cylinders 51, the compression spring units 52 will primarily cause the forward movement.

The paving machine 10 moves in the forward direction to do a secondary move by extracting the piston rod of the cylinders 51 pushing units 33 and 49 carrying the mold unit against the mold units already positioned on a prepared bed 120. The paving machine 10 combined with the main roller base 37 moves forward over the mold units already positioned on the prepared bed. The power locks 44 releases the mold unit and units 33 and 49 moves back to its start up location.

Figure 2:
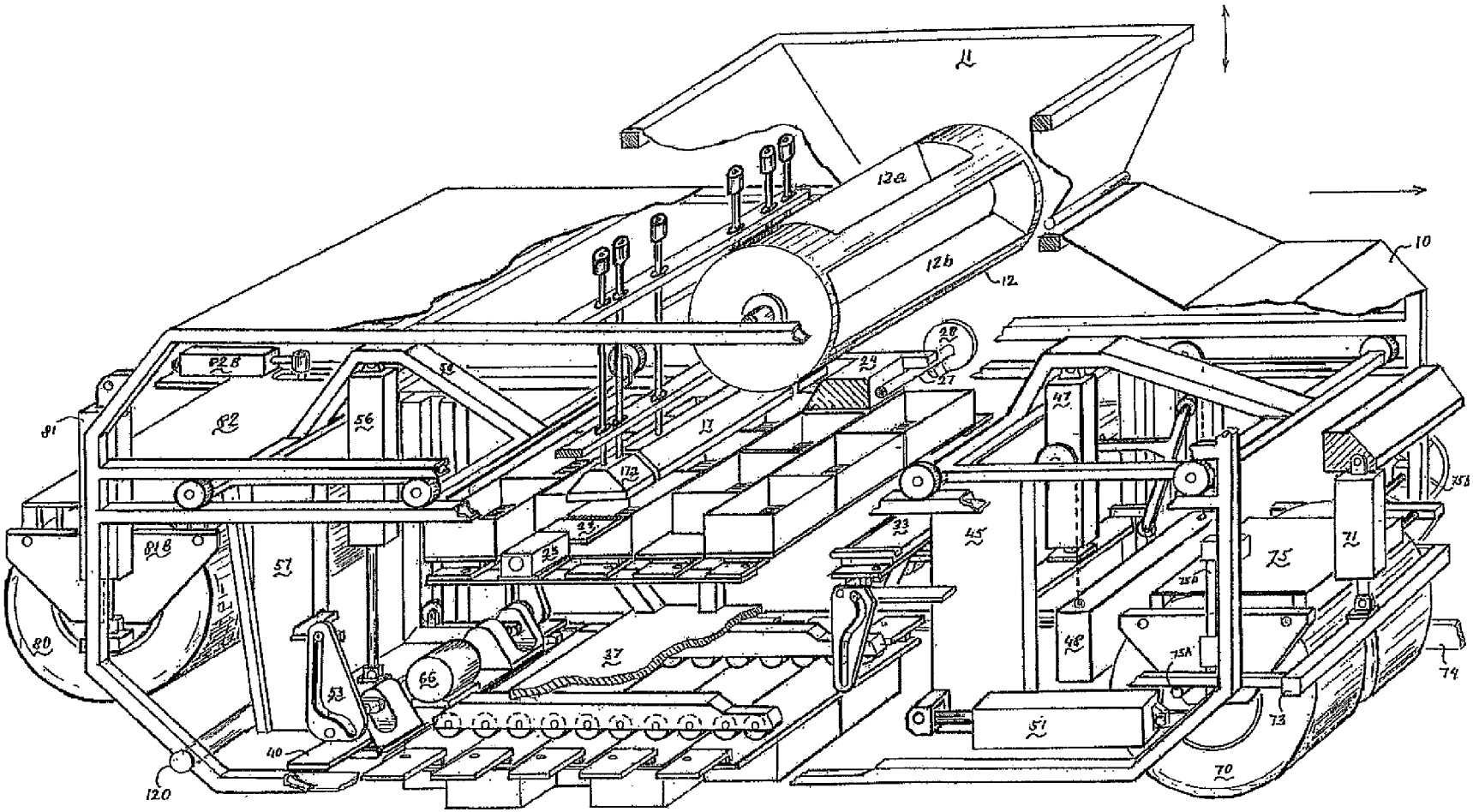
FIG. 2 is a perspective view of the paving apparatus with some parts shown removed for illustrative purposes.
Figure 3:
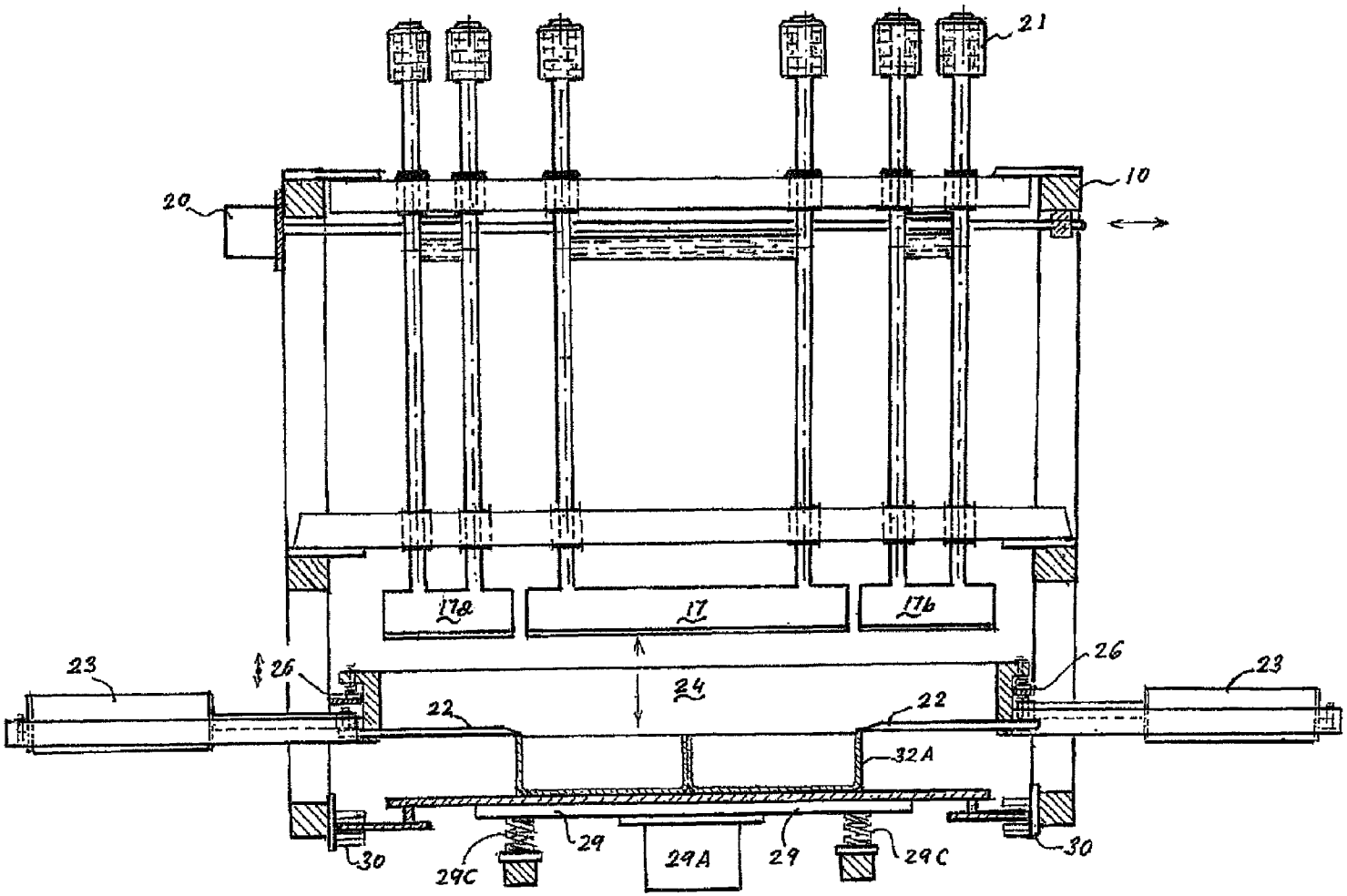
FIG. 3 is a cross sectional view of the packing mechanism above one of the molds in the casting position along a laterally extending vertical plane.
Figure 4:
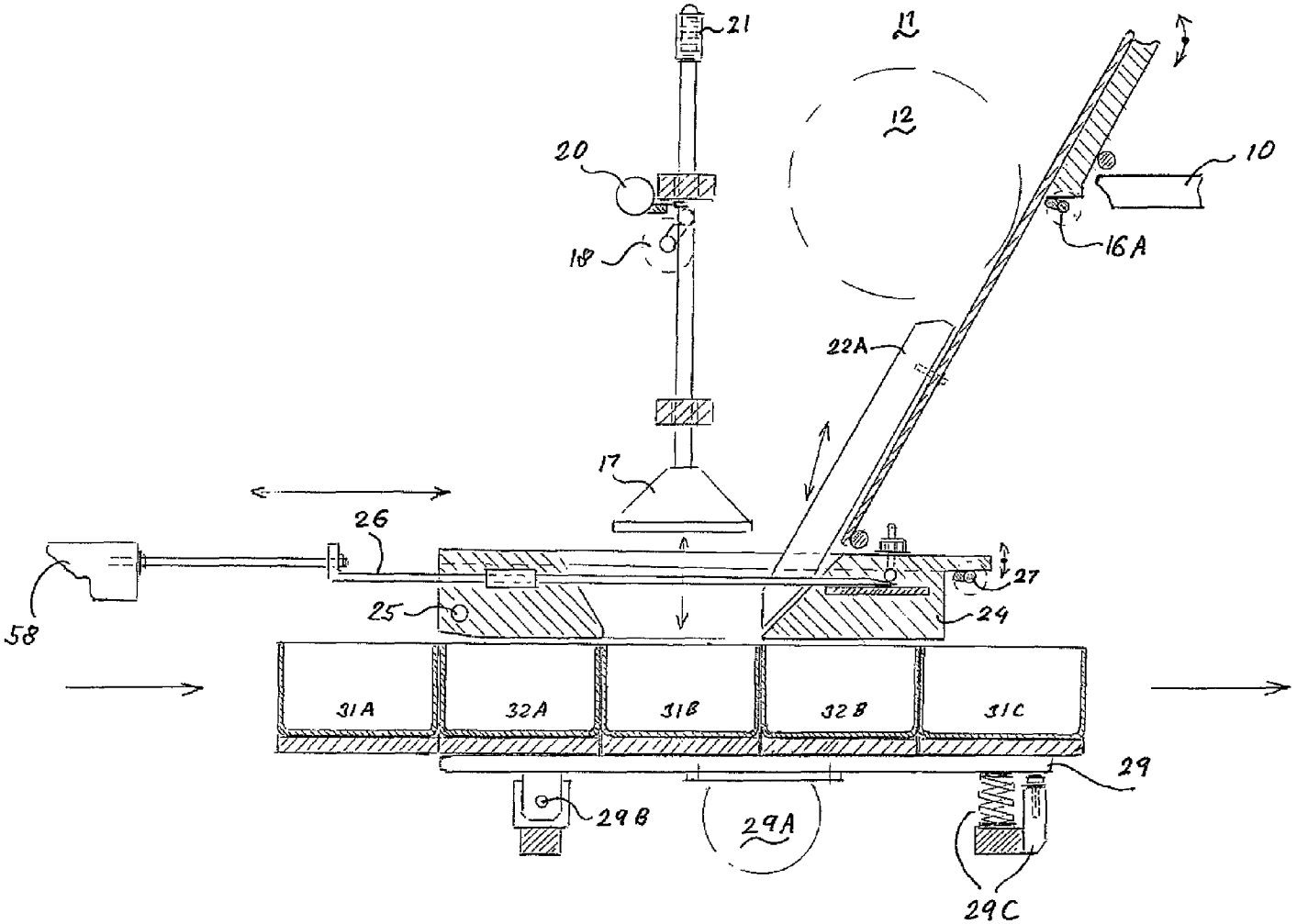
FIG. 4 is a cross section view of the packing mechanism above the molds in the casting position along a longitudinally extending vertical plane.
Figure 5:
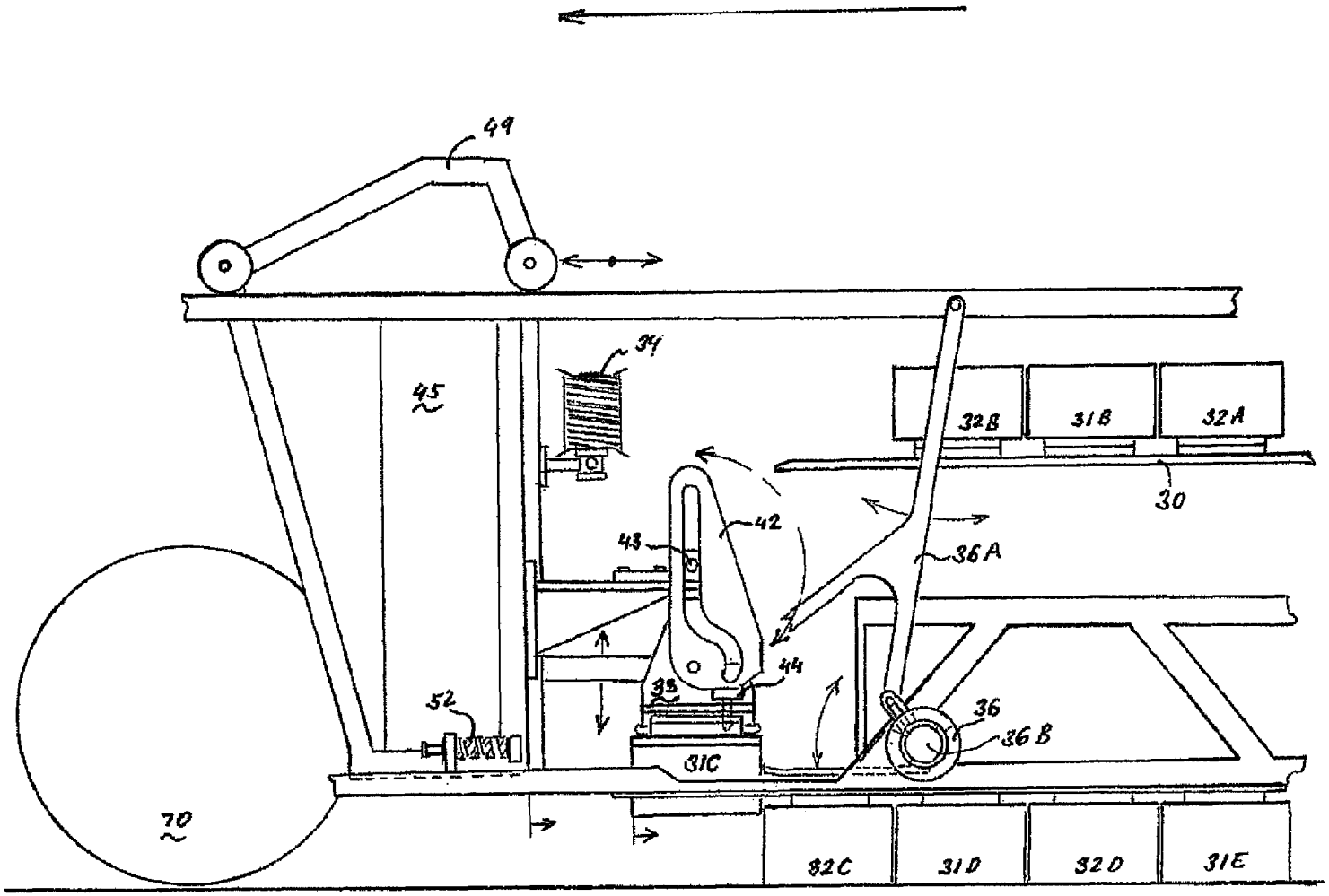
FIG. 5 is a side elevational view of the first portion of the conveying mechanism at the front end of the paving apparatus.

The pick up units 40 and 58 are positioned at the start up location in FIGS. 1 and 2. The power locks 65 secure the mold unit to unit 40. The hammers 39 and hammer action vibrator 66 are directly in contact with main mold unit base to act in the releasing process. The unit 40 carrying mold unit moves slowly straight upwards by retracting the piston rod of cylinder 56.

After the paving stone is released from the mold unit, units 40 and 58 are switched to fast mode to finish their movement as unit 40 and 58 are pushed outwards by extracting the piston rod of the cylinders 59A. The unit 40 rotates 180 degrees around the anchored pivots 54 by retracting the piston rod of the cylinder 56. The power locks 41 open up to allow units 40 and 58 to move inwards. The units 40 and 58 carrying empty mold units moves inwards by retracting the piston rod of cylinders 59A and starts pushing mold units positioned on the press base 29 forward. The power locks 65 releases mold unit and units 40 and 58 moves back to its pick up location.

When the paving machine 10 is in use, the rear wheel 80 is lifted up by retracting piston rods of cylinders 81. The aligner 74, combined with the front wheel 70 and the front aligner assembly 75H and the clutch 75F in the off position, is used to guide the paving machine 10 along the edge of the curb row already laid.

The front wheel assembly combined with leveling valve keeps the paving machine in proper level.

Most of the paving machine weight is purposely sitting on the mold units already positioned on the prepared bed supported by the main roller base 37.

The sweeper unit 60 cleans up the mold unit cavities using high pressure water combined with vacuum power.

The agent unit 61 deposits release agent in to mold cavities. Due to continuous duty, there may be no need for a release agent depending on the various applications of the castable material used by this paving method. Some materials may require release agents or coatings more than others.

Since the castable material is not cured yet, the paving machine spray paint head box 400 can apply paint or another coating over the uncured paving stones allowing deep penetration and bonding prior to the time the paving stones cures. Also, various colors can be used to create an art form, decorative pavement lines, etc.

The front and rear wheel 70 and 80 are pushed downwards to lift up the paving machine off the ground by extracting piston rods of the cylinders 81 and 71. By using power unit 75A and engaging the clutch 75F combined with the rear steering wheel 80, the paving machine can be move around and steered.

The front and rear linear actuators 75B, 82D are used for precise side engagement.

As shown in FIG. 6, the fresh laid paving stones can be easily cut to a desired shape shown by the outline 300 using a simple knife, for example a bread knife.

The paving machine 10 generally requires a supply of castable material, a supply of electric power, a supply of compressed air, a supply of high pressure water, and vacuum power. Paint and release agents are optional.

The paving machine is controlled from control unit 100 consisting of commonly used components such as limit switches, solenoid valves, relays, piston cylinder, actuators, control valves, pressure valves, flow controls, etc.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A paving apparatus for placing a plurality of paving stones on a supporting surface to be paved, the apparatus comprising:

a main frame supported for movement along the supporting surface in a forward working direction;

a hopper supported on the main frame and arranged to receive castable material therein;

a plurality of molds, each comprising at least one mold cavity arranged to receive castable material from the hopper therein such that each mold cavity of the plurality of molds is arranged to form a respective one of the plurality of paving stones; and a conveying mechanism supported on the main frame and including:

a first portion supporting the molds for respective movement from a casting position in alignment with the hopper to a placing position arranged to dispense a cast paving stone therefrom onto the supporting surface; and a second portion supporting the molds for respective movement from the placing position back to the casting position.

2. The apparatus according to claim 1 wherein the conveying mechanism is arranged to release each mold from the first portion of the conveying mechanism at a location spaced forwardly from the second portion prior to engaging the mold with the second portion of the conveying mechanism.

3. The apparatus according to claim 1 wherein the conveying mechanism includes a casting section arranged to support each mold in the casting position and wherein the conveying mechanism is arranged to release each mold from the second portion of the conveying mechanism at the casting section prior to engaging the mold with the first portion of the conveying mechanism.

4. The apparatus according to claim 1 wherein each mold comprises a plurality of mold cavities.

5. The apparatus according to claim 4 wherein the mold cavities of each mold are arranged in a respective lateral row of cavities and wherein the molds include first and second mold types in which the mold cavities of the first mold type are staggered so as to be laterally offset from the mold cavities of the second mold type.

6. The apparatus according to claim 1 wherein the main frame includes a placing section extending in a longitudinal direction rearwardly from the first portion of the conveying mechanism at a forward end of the main frame to the second portion of the conveying mechanism at a rearward end of the main frame, the placing section being arranged to receive a longitudinally extending row of the molds in the respective placing position.

7. The apparatus according to claim 6 wherein the main frame includes a roller base arranged to support the main frame for rolling movement in the forward working direction on the longitudinally extending row of molds in the placing section between the first and second portions of the conveying mechanism.

8. The apparatus according to claim 7 wherein the roller base is centrally located between the front and rear ends of the main frame so as to be arranged to substantially fully support a weight of the apparatus thereon.

9. The apparatus according to claim 1 wherein there is provided a biasing mechanism arranged to bias each mold during placement on the supporting surface rearwardly against one of the molds previously placed on the supporting surface.

10. The apparatus according to claim 1 further comprising a metering mechanism arranged to deliver metered portions of castable material from the hopper to the molds in the casting position.

11. The apparatus according to claim 10 wherein the molds include first and second mold types which are different in configuration from one another and wherein the metering mechanism is arranged to deliver first and second metered portions to the first and second mold types respectively.

12. The apparatus according to claim 1 further comprising a packing tool supported on the main frame above the molds in the casting position, the packing tool include a packing head arranged for engaging an open side of the molds and a driver arranged to substantially vertically reciprocate the packing head so as to be arranged for packing the castable material in the molds.

13. The apparatus according to claim 11 wherein the molds include first and second mold types which are different in configuration from one another and wherein the packing head of the packing tool comprises modular sections, the driver being arranged to reciprocate different ones of the modular sections of the packing head in first and second packing modes corresponding to the first and second mold types respectively.

14. The apparatus according to claim 1 further comprising a primary packing tool supported on the main frame above the molds in the casting position so as to be arranged to pack the castable material in the molds in the casting position, and a secondary packing tool on the main frame arranged to pack the castable material in the molds in a secondary packing position forwardly in relation to packing by the primary packing tool in the casting position.

15. The apparatus according to claim 1 wherein the molds include first and second mold types which are different in configuration from one another and wherein there is provided a chute arranged to guide castable material from the hopper into each mold in the casting position, the chute including gate members mounted for sliding movement relative to the chute so as to be arranged to vary the chute between first and second configurations corresponding to the first and second mold types respectively.

16. The apparatus according to claim 1 further comprising a sweep mechanism supported on the main frame so as to be arranged to sweep respective sides of each mold when the mold is supported by the first portion of the conveying mechanism.

17. The apparatus according to claim 16 further comprising a return mechanism arranged to convey material swept by the sweep mechanism to the hopper.

18. The apparatus according to claim 1 further comprising a hammering mechanism including a reciprocating hammer arranged to engage each mold in the placing position so as to be arranged to release the respective cast paving stone from the mold.

19. The apparatus according to claim 1 wherein the conveying mechanism is arranged to dispense cast paving stones on the supporting surface in a longitudinally extending row as the main frame is displaced in the forward working direction and wherein there is provided an alignment tool on the main frame arranged to guide the main frame along a previously placed longitudinally extending row of cast paving stones as the main frame is displaced in the forward working direction.

20. The apparatus according to claim 1 wherein the main frame includes a roller base arranged to support the main frame for rolling movement on molds placed on the supporting surface in the placing position and wherein there is provided front and rear wheels at respective forward and rearward ends of the main frame, the front and rear wheels being adjustable in height relative to the roller base so as to be arranged to support the main frame thereon with the roller base spaced above the ground in a transport position.

21. The apparatus according to claim 1 wherein the main frame includes a roller base arranged to support the main frame for rolling movement on molds placed on the supporting surface in the placing position and wherein there is provided a front wheel on the main frame spaced forwardly of the roller base, the front wheel being lower in elevation than the roller base so as to be arranged for rolling movement on the supporting surface when the roller base rolls on the molds in the placing position.

22. The apparatus according to claim 21 wherein the front wheel comprises a roller which spans a majority of a width of the apparatus in a lateral direction.

23. The apparatus according to claim 21 wherein the front wheel is adjustable in position relative to the main frame in a lateral direction oriented transversely to the forward working direction.

24. The apparatus according to claim 1 further comprising a sweep mechanism supported on the main frame so as to be arranged to sweep an interior of each mold when the mold is supported by the second portion of the conveying mechanism.

25. The apparatus according to claim 1 further comprising a release sprayer mounted on the main frame and arranged to spray a mold releasing agent into each mold at a location prior to the casting position.

26. The apparatus according to claim 1 further comprising a finish sprayer mounted on a rear end of the main frame so as to be arranged to spray a finish coating on an upper surface of the cast paving stones on the supporting surface subsequent to the respective mold being engaged by the second portion of the conveying mechanism.

* * * * *